US008615831B2

(12) United States Patent
Lipman et al.

(10) Patent No.: US 8,615,831 B2
(45) Date of Patent: Dec. 31, 2013

(54) SELF INFLATING AIR MATTRESS

(75) Inventors: Shawn Lipman, Calabasa, CA (US); John R. Laverack, Southbury, CT (US); George E. Riehm, New Fairfield, CT (US); Edward A. Gilchrest, Jr., Oxford, CT (US)

(73) Assignee: Joerns Healthcare, LLC, Charlotte, NC (US)

( * ) Notice: Subject to any disclaimer, the term of this patent is extended or adjusted under 35 U.S.C. 154(b) by 0 days.

(21) Appl. No.: 13/610,137

(22) Filed: Sep. 11, 2012

(65) Prior Publication Data

US 2013/0000048 A1 Jan. 3, 2013

Related U.S. Application Data

(63) Continuation of application No. 11/704,769, filed on Feb. 9, 2007, now Pat. No. 8,261,387.

(60) Provisional application No. 60/772,453, filed on Feb. 10, 2006.

(51) Int. Cl.
*A47C 27/10* (2006.01)

(52) U.S. Cl.
USPC ..... 5/710; 5/655.9; 5/713; 5/714; 5/709

(58) Field of Classification Search
USPC ..... 5/706–715
See application file for complete search history.

(56) References Cited

U.S. PATENT DOCUMENTS

| | | | | | |
|---|---|---|---|---|---|
| 2,886,834 | A * | 5/1959 | Gilbertson | ..... | 5/709 |
| 5,267,364 | A * | 12/1993 | Volk | ..... | 5/713 |
| 5,634,225 | A * | 6/1997 | Miller et al. | ..... | 5/710 |
| 6,014,784 | A * | 1/2000 | Taylor et al. | ..... | 5/713 |
| 6,269,505 | B1 * | 8/2001 | Wilkinson | ..... | 5/713 |
| 6,564,411 | B2 * | 5/2003 | Pirzada | ..... | 5/713 |
| 6,839,929 | B2 * | 1/2005 | Stolpmann | ..... | 5/710 |
| 2002/0116766 | A1 * | 8/2002 | Stolpmann | ..... | 5/710 |
| 2003/0110568 | A1 * | 6/2003 | Stolpmann | ..... | 5/710 |

* cited by examiner

*Primary Examiner* — William Kelleher
(74) *Attorney, Agent, or Firm* — MacMillan, Sobanski & Todd, LLC

(57) ABSTRACT

A mattress includes a plurality of air cells. Each cell has a low air permeability envelope and a foam inflation structure that defines one or more voids inside the low air permeability envelope. The foam inflation structures expand when unloaded to cause inflation of the one or more voids. When unloaded, the ratio of the volume of the foam inflation structure to the volume of the one or more voids within the low air permeability envelope is not the same in all the cells.

20 Claims, 11 Drawing Sheets

Time 0 Initial optimal pressures

Time 1 Volume of air leaks through natural osmosis

Time 3 When User is off the mattress and the Mattress reinflates automatically

Time 4 Optimal pressures restored

SELF INFLATING AIR MATTRESS

CROSS REFERENCE TO RELATED APPLICATIONS

This application claims the benefit of U.S. patent application Ser. No. 11/704,769, filed on Feb. 9, 2007, which claimed the benefit of U.S. Provisional patent application No. 60/772,453, filed on Feb. 10, 2006. The disclosures of both applications are incorporated herein by reference.

BACKGROUND OF INVENTION

The present invention generally relates to beds, and more particularly to mattresses, particularly self-inflating mattresses, which may be inflated without using external tools.

Individuals who lack mobility may spend hours in a single position. This may cause high point pressure contact at bony prominences, which are areas of the body, such as, the shoulder blades, sacrum, and heels, that have a relatively thin layer of skin over bone. This, in turn, may cause a reduction of blood flow and skin breakdown, leading to decubitus ulcers.

Inflatable mattresses may distribute a user's weight over an area to reduce high point pressure contact. There are generally two types of inflatable mattresses: these are low air loss mattresses and alternating pressure mattresses.

Low air loss mattresses may be made up of air cells having a surface through which air is constantly lost. These mattresses are supported by the provision of a continuous air supply. Low air loss mattresses often include a plurality of zones, typically head, seat, and foot zones. Optimally, the mattress surface conforms to the user's anatomy to reduce high point pressure contact.

Alternating pressure mattresses are made up of air cells arranged so that adjacent air cells are alternately inflated and deflated so that areas of the user's body in contact with the cells are alternately at high and low pressures.

SUMMARY OF INVENTION

This invention relates to a mattress that includes a plurality of air cells. Each cell has a low air permeability envelope and a foam inflation structure that defines one or more voids inside the low air permeability envelope. The foam inflation structures expand when unloaded to cause inflation of the one or more voids. When unloaded, the ratio of the volume of the foam inflation structure to the volume of the one or more voids within the low air permeability envelope is not the same in all the cells.

This invention also relates to a mattress that includes a plurality of air cells. Each air cell has a low air permeability envelope and a foam inflation structure that defines one or more voids inside the low air permeability envelope. The foam inflation structures expand when unloaded to cause inflation of the one or more voids. When unloaded, the ratio of the volume of the foam inflation structure to the volume of the one or more voids within the low air permeability envelope is not the same in all the cells. The mattress also includes a plurality of zones, with each zone including at least one air cell. The mattress also includes a plurality of check valves, and each zone has a check valve that permits air flow into the air cells in the zone and prevents air flow from the air cells in the zone.

This invention also relates to a mattress that includes a plurality of air cells. Each air cell has a low air permeability envelope and a foam inflation structure that defines one or more voids inside the low air permeability envelope. Each inflation structure expands when unloaded to cause inflation of the one or more voids. When unloaded, the ratio of the volume of the foam inflation structure to the volume of the one or more voids within the low air permeability envelope is not the same in all the cells. The mattress also includes a plurality of zones, and each zone includes at least one air cell. The mattress includes a plurality of groups of air cells, each of the groups of air cells comprising alternating air cells in one zone, and each zone includes air cells in two different groups of air cells. The mattress includes a plurality of check valves, with each of the check valves permitting air flow into the air cells in one of the group of air cells and preventing air flow from the air cells in the same group of air cells.

Various aspects of this invention will become apparent to those skilled in the art from the following detailed description of the preferred embodiment, when read in light of the accompanying drawings.

DETAILED DESCRIPTION

Figure 1:
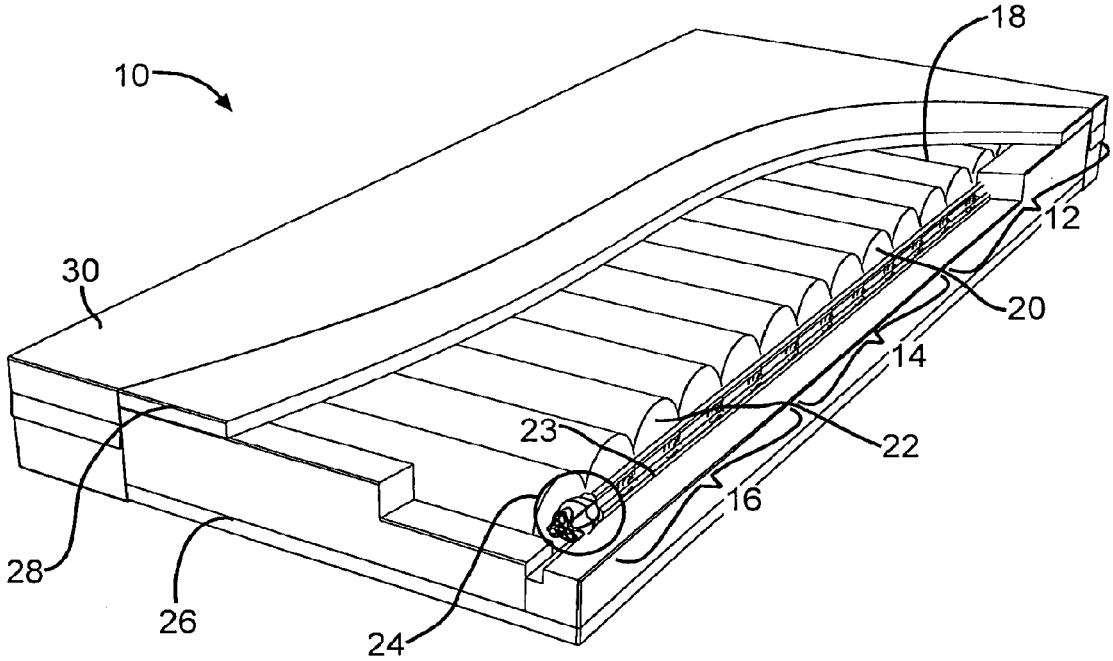
FIG. 1 is a top perspective partially cutaway view of a non-powered mattress.

Referring now to the drawings, there is illustrated in FIG. 1 a top perspective partially cutaway view of an exemplary non-powered self-inflating mattress, generally indicated at 10, which may be inflated without the aid of an external tool, such as an external air pump. The mattress 10 is capable of providing a surface pressure profile that simulates a conventional low air loss mattress.

Figure 2:
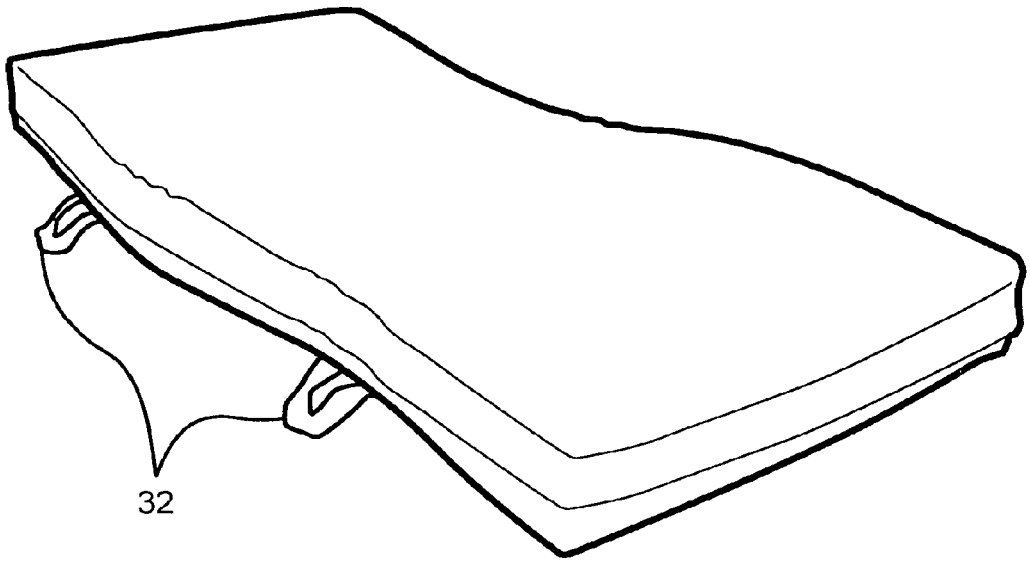
FIG. 2 is a top perspective view of the mattress in FIG. 1.

The mattress 10 shown has three different zones, namely a head zone 12, a seat zone 14, and a foot zone 16. Each zone 12, 14, 16 may include one or more air cells 18, 20, 22. The cells 18, 20, 22 may be connected to other cells in the same zones 12, 14, 16 but not to cells in other zones each other via hoses 23 to check valves 24, which allow one way air flow to permit air to enter but not exit the cells 18, 20, 22. A surround 26 and topper 28 are preferably formed from a resilient material that provides improved pressure relief and support to increase user comfort. The surround 26 and topper 28 may be covered by an anti-bacterial, anti-fungal top cover 30 that may be formed from a material that is fluid, stain and odor resistant. The cover 30 may include one or more ties 32, as shown in FIG. 2, for holding the mattress 10 in a generally fixed position in relation to a bed deck. The mattress 10 is suitable for use on an articulation bed and is thus not limited to a planar configuration shown.

Figure 3:
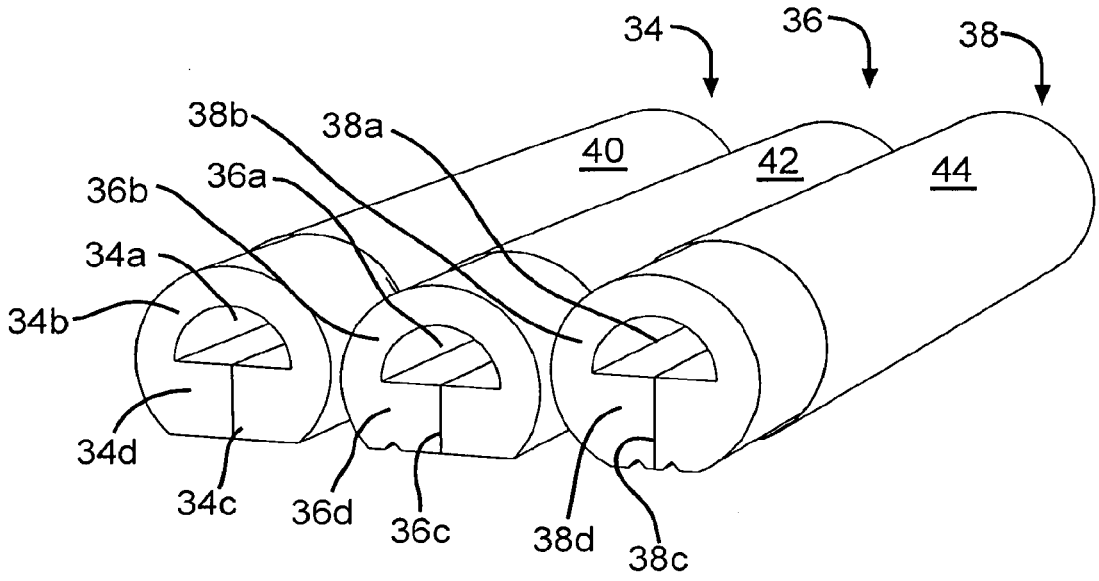
FIG. 3 is a perspective view of an exemplary construction for representative cells of the mattress, wherein the cells have different amounts of foam filling.

In FIG. 3, there is illustrated a perspective view of an exemplary construction for representative air cells 18, 20, 22. As shown in drawing, the cells 18, 20, 22 may be in the form of tubular air cells. The cells 18, 20, 22 may be filled with different quantities of foam fill. The foam fill may be in the form of a low durometer foam. The foam is preferably very soft so that the foam does not provide principal support for the user. In this way, the user may be supported by the air in the cells 18, 20, 22 rather than by the foam. The foam may be sealed with polyurethane (urethane) or other suitable sealing material, including but not limited to, for example, nylon coated with polyurethane, vinyl (polyvinylchloride), or nylon coated with vinyl. These materials are preferred as they may permit the cells to be made via radio frequency welding. Urethane is preferred as it it flexible and complient and resists perforation through inherent strength.

It should be appreciated that the cells 18, 20, 22 may be tuned, for example, by varying the amount of foam in the cells 18, 20, 22. By varying the amount of foam in the cells 18, 20, 22, differential volumes of air may be established in each of the zones 12, 14, 16. For example, the cells 20 in the seat zone 16 may have the least amount of foam, the cells 18 in the head zone 18 may have more foam than the cells 20 in the seat zone 16 (i.e., a medium amount of foam), and the cells 22 in the foot zone 16 may have the most foam. These cell configurations are represented in FIG. 3.

Tuning of the cells 18, 20, 22 may be done in any suitable manner. For example, measurements may by taken using a conventional low air loss mattress to determine the amount of air in corresponding head, seat and foot zones with an average user resting on the mattress. In doing so, it was found that the air cells in the seat zone, which supports the user's main torso, which makes up most of the user's total body mass, have the least volume of air. The head zone air cells have a greater volume of air than the seat zone air cells because the head zone air cells support the user's upper torso, which is made up of the user's upper chest, shoulders, and head, which are lighter than the user's main torso. The air cells in the foot zone have the greatest volume of air because the user's legs are lighter than the main and upper torsos and thus form the least amount of the user's total body mass.

Figure 4:
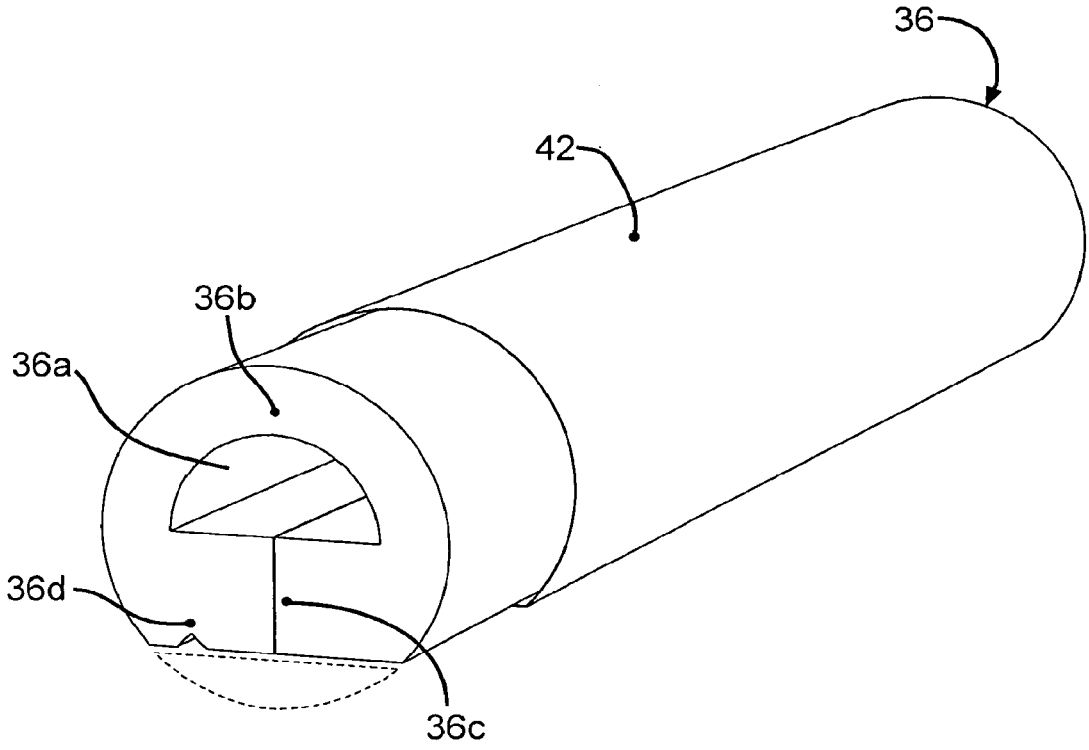
FIG. 4 is a perspective view an exemplary construction of a single cell.

The aforementioned measurements may be used to determine the amount of air needed in each cell 18, 20, 22 of the exemplary mattress 10 so as to simulate the feel of a conventional low air loss mattress. A corresponding relationship may be established between the amount of air needed in each cell 18, 20, 22 and the amount of foam in each cell 18, 20, 22. The foam in the cells 18, 20, 22 in each zone 12, 14, 16 may be varied in any suitable manner. For example, the cells 18, 20, 22 shown in FIG. 3 are formed from foam inserts 34, 36, 38 that are similar in shape. The foam inserts 34, 36, 38 shown are cylindrical in shape with a portion removed to reduce the volume of the foam inserts 34, 36, 38, the volume of the removed portion being dependent on the cell zone 12, 14, 16. In FIG. 4, an exemplary construction of the foam insert 36 for the seat zone 14 is shown with such a portion (shown in hidden line) removed along the length of the insert 36. In accordance with this technique, the heights of the various cells 18, 20, 22 may be substantially unaffected, or affected only slightly, while achieving a reduced volume for each respective cell 18, 20, 22.

To aid in assembly of the mattress 10, the foam inserts 34, 36, 38 may be differentiated from one another, for example, by the absence or presence of one or more identifiers, such as the minor marking notches shown but not referenced in the drawings. The absence or presence of identifiers functions as coding for the foam elements 34, 36, 38.

Referring back to FIG. 3, each foam insert 34, 36, 38 may be hollowed out to produce a hollow space 34*a*, 36*a*, 38*a* with a thin portion 34*b*, 36*b*, 38*b* above the hollow space 34*a*, 36*a*, 38*a* to reduce the supportive effect of the foam insert 34, 36, 38 to the user. A slice 34*c*, 36*c*, 38*c* may be provided in a lower portion of each foam insert 34, 36, 38 and the inserts 34, 36, 38 may be designed with an inner profile that aids in cutting foam from blocks of foam material during the formation of the foam inserts 34, 36, 38. A thick portion 34*d*, 36*d*, 38*d* below the hollow space 34*a*, 36*a*, 38*a* may be provided to reduce the risk that the portions 34*d*, 36*d*, 38*d* will become dislocated at the slice 34*c*, 36*c*, 38*c*. Such dislocation may reduce the outer perimeter dimension of the foam inserts 34, 36, 38, which may modify the volume of air drawn into the cells 18, 20, 22 by the foam inserts 34, 36, 38 during inflation of the cells 18, 20, 22, as will be understood in the description that follows.

As further shown in FIG. 3, the foam inserts 34, 36, 38 may be sealed with an outer wall 40, 42, 44, which may cover the foam inserts 34, 36, 38 so as to function like a low air permeability envelope. The walls 40, 42, 44 may be formed from a transparent, translucent or other suitable material that may aid in easily identifying the cell identifiers so that the foam inserts 34, 36, 38 can easily be differentiated from one another during assembly of the mattress 10 for positioning of the foam inserts 34, 36, 38 in the proper cells 18, 20, 22.

Figure 5A:
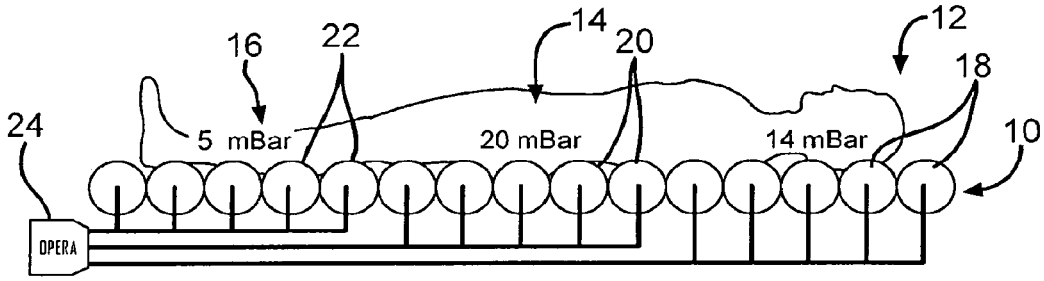
FIGS. 5A-5D are diagrammatic environmental side elevational views of the mattress at various stages of use.

In FIG. 5A, there is shown a side elevational view of the mattress 10 in use supporting a user. The cells 18, 20, 22 are disposed in three zones 12, 14, 16. With a 175 pound user, the head zone 12 may, for example, have a nominal pressure of 14 mBar, the seat zone 14 may have a nominal pressure of 20 mBar, and the foot zone 16 may have a nominal pressure of 5 mBar. These pressures may be controlled by the foam volume within the cells 18, 20, 22. The foam inserts 34, 36, 38 are provided to inflate each cell 18, 20, 22 though the check valves 24. When the user lies on the mattress 10, the different volumes are reflected by different pressure rises in the respective zones 12, 14, 16.

Figure 5B:
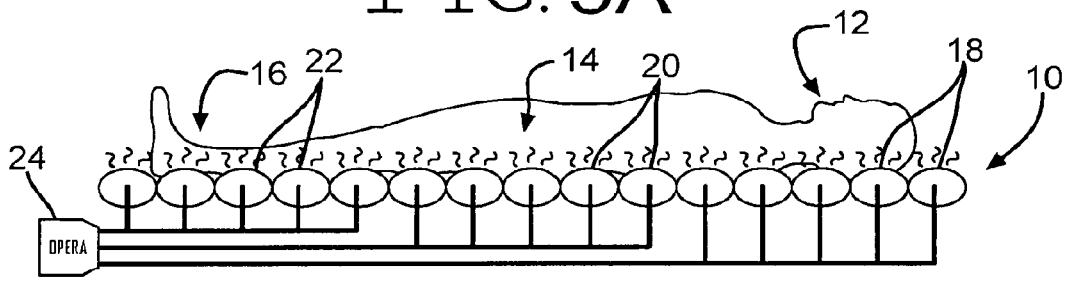
Figure 5C:
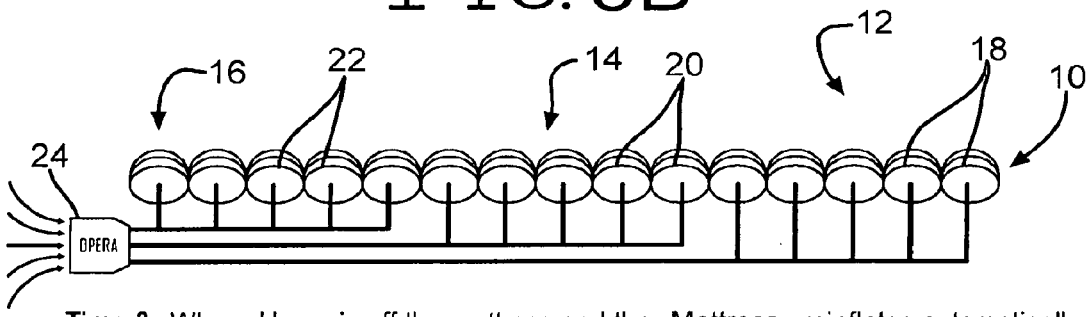
Figure 5D:
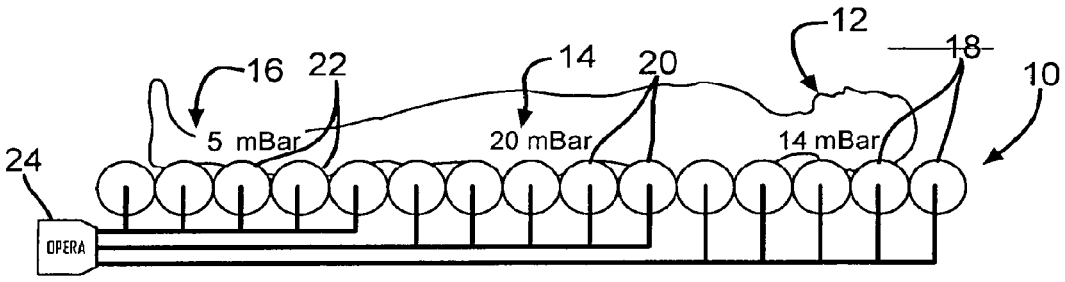

It should be appreciated that, as the mattress 10 supports a user over a period of time, air in the cells 18, 20, 22 may diffuse through the walls 40, 42, 44, causing the cells 18, 20, 22 to deflate, just like a balloon, resulting in compression of the foam inserts 34, 36, 38 in the cells 18, 20, 22, as graphically depicted in FIG. 5B. When the user is removed from the mattress 10, as shown in FIG. 5C, the foam inserts 34, 36, 38 decompress or expand, thereby expanding the cells 18, 20, 22, as depicted in FIG. 5D. The expansion of the foam inserts 34, 36, 38 draws air through the check valves 24 to inflate the cells 18, 20, 22 without the need of an external tool.

When in use, the inflated mattress 10 exhibits slow leakage of air. The air loss may be caused by diffusion, pinhole leaks, leaks through valves and tubing or hose connections, and the like. The leakage is compensated for by an automated refill function, without requiring an external tool.

The automated refill function is provided by the foam inserts 34, 36, 38. The foam inserts 34, 36, 38 function as an internal rebound or inflation structure, which causes inflation of the cells 18, 20, 22 by drawing air through the check valves 24 when the mattress 10 is not in use. The inserts 34, 36, 38 are preferably formed from any suitable memory material that provides sufficient resiliency to restore the cells 18, 20, 22 to their nominal shape.

The pressure in each cell 18, 20, 22 may increase to equal the pressure required to support the user. That is, the average pressure on the user may equal the weight of the user divided by the mattress surface area contacted. By controlling the initial volume of air within a cell 18, 20, 22 via the shape of the foam inserts 34, 36, 38, the compliance of the cell 18, 20, 22 may be determined, and when the user lies on the mattress 10, the area contacted may be correspondingly determined, allowing the controlled distribution of pressure over the body of the user.

The major support properties of the cells 18, 20, 22 are defined by the volume of air in the cells 18, 20, 22 and the cell walls 40, 42, 44. The cell walls 40, 42, 44 are relatively flaccid when the mattress 10 is not in use. Although the cell wall 40, 42, 44 of each cell 18, 20, 22 is preferably similar, regardless of the foam insert size and shape, under various conditions, different cell wall configurations may be employed.

Although the air inside the cells 18, 20, 22 is preferably the most significant factor in determining the support characteristics of the cells 18, 20, 22, the foam inserts 34, 36, 38 may make some contribution to the support characteristics and feel of the mattress 10. However, the inserts 34, 36, 38 are principally provided to inflate the mattress 10. Since the foam inserts 34, 36, 38 expand the cells 18, 20, 22 when unloaded, it is possible to keep the pressure contribution of the foam inserts 34, 36, 38 to a low level.

Each cell 18, 20, 22 is preferably individually tuned to a particular air volume so that regional control over support provided by the mattress 10 can be achieved. The air cells 18, 20, 22 are aligned transversely to the longitudinal axis of the mattress 10 and arranged in zones to provide regionally varying properties. By arranging the cells 18, 20, 22 transversely, various pressure zones may be defined along the length of the user's body. Although head, seat and foot zones are described, various numbers of zones and zone geographies may be provided.

The different zones may differ in the amount of foam in the cells, and generally the ratio of foam volume to void volume within the cells. Although the foam may generally make some contribution to the support surface characteristics, by controlling the mechanical characteristics and configuration of the foam, this contribution may be as desired, which is preferably as minimal as possible while assuring reliable inflation of the cells when the mattress is unloaded.

It should be appreciated that cells 18, 20, 22 within each zone 12, 14, 16 may be linked to the other cells 18, 20, 22 in the same zone 12, 14, 16. This permits a plurality of cells within each zone to be controlled together by a single check valve 24.

The foregoing mattress configuration may function as a conventional powered low air loss mattress, while permitting passive and automated inflation of the cells 18, 20, 22.

Figure 6:
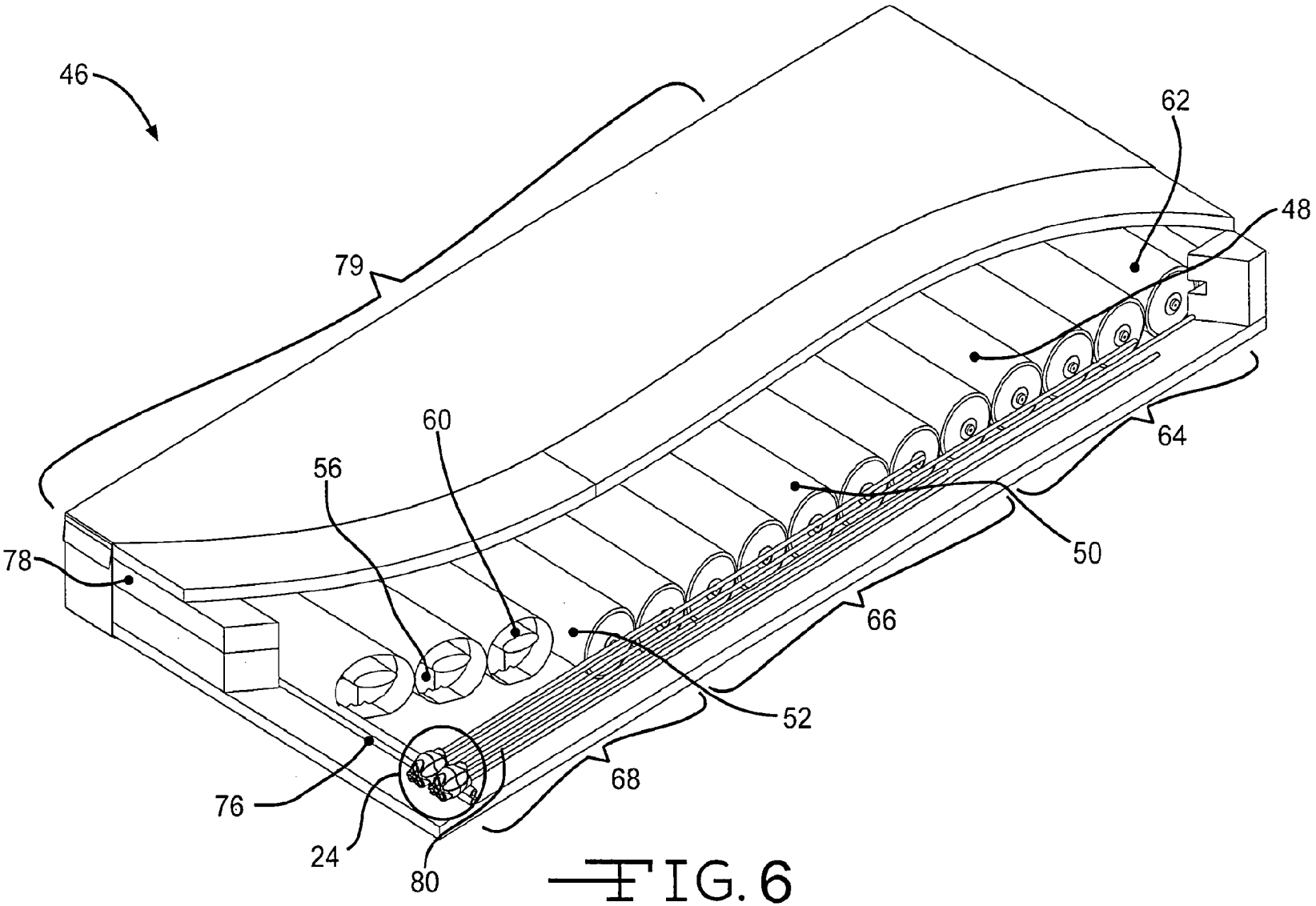
FIG. 6 is a top perspective partially cutaway view of an optionally powered mattress.

Now with reference to FIG. 6, there is illustrated a top perspective partially cutaway view of an optionally powered mattress 46. The construction of this mattress 46 is similar to that of the non-powered mattress 10 described above but adds the capability of working in conjunction with an external tool, such as an air pump and controller that are capable of producing an alternating pressure.

Figure 7:
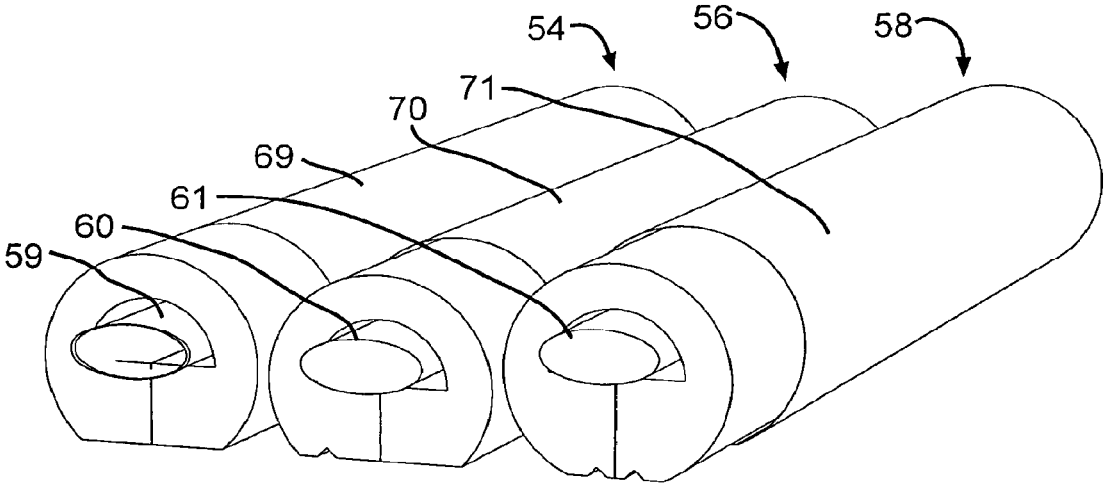
FIG. 7 is a perspective view of an exemplary construction for representative cells of the optionally powered mattress, wherein the cells have different amounts of foam filling.
Figure 8:
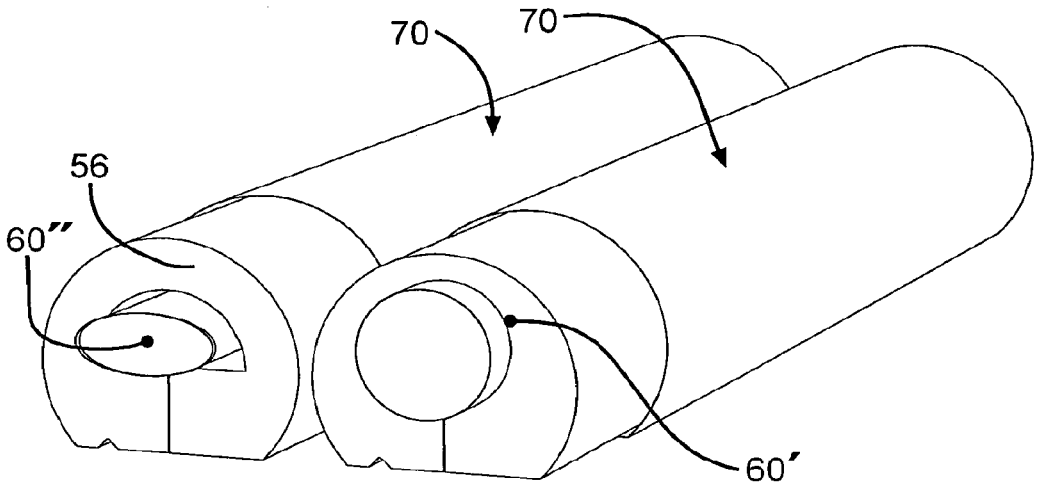
FIG. 8 is a perspective view of an exemplary construction for representative cells of the optionally powered mattress, wherein one of the cells is inflated and another is deflated.
Figure 9A:
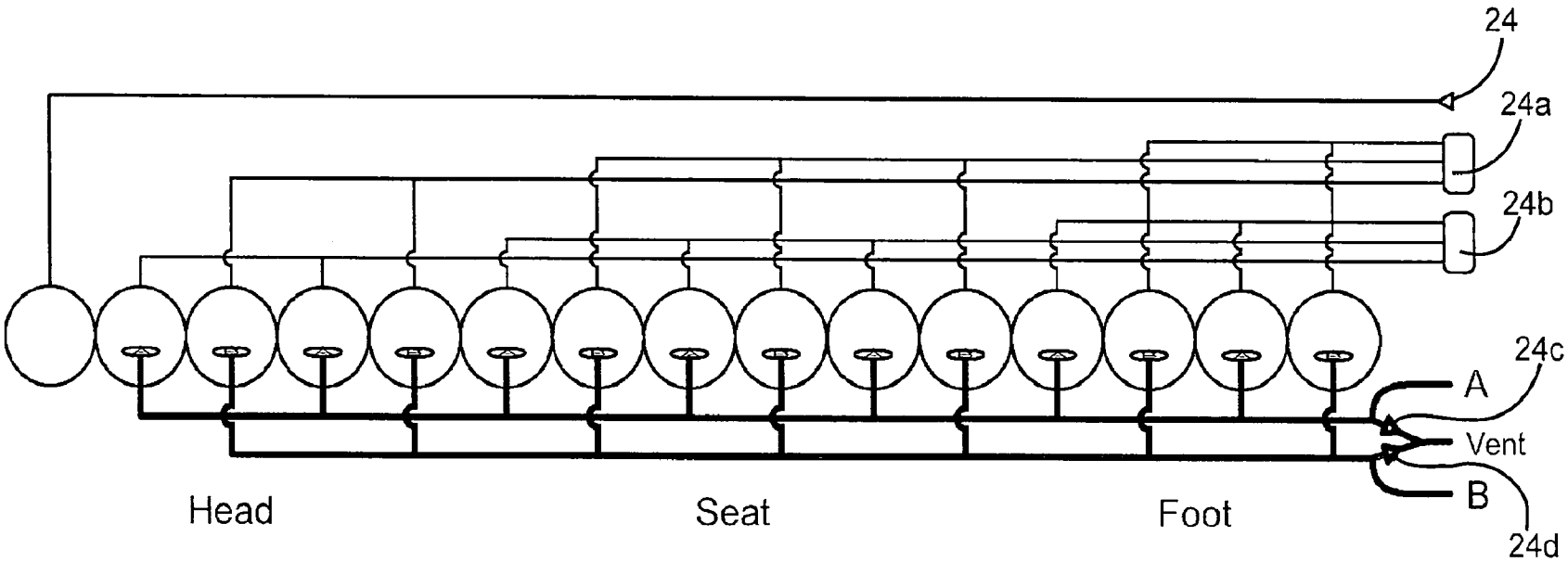
FIGS. 9A-9C are diagrammatic side elevational views of the optionally powered mattress, showing inner walls of alternating cells in three separate zones, wherein the inner walls are subject to alternating pressure inflation phases.
Figure 9B:
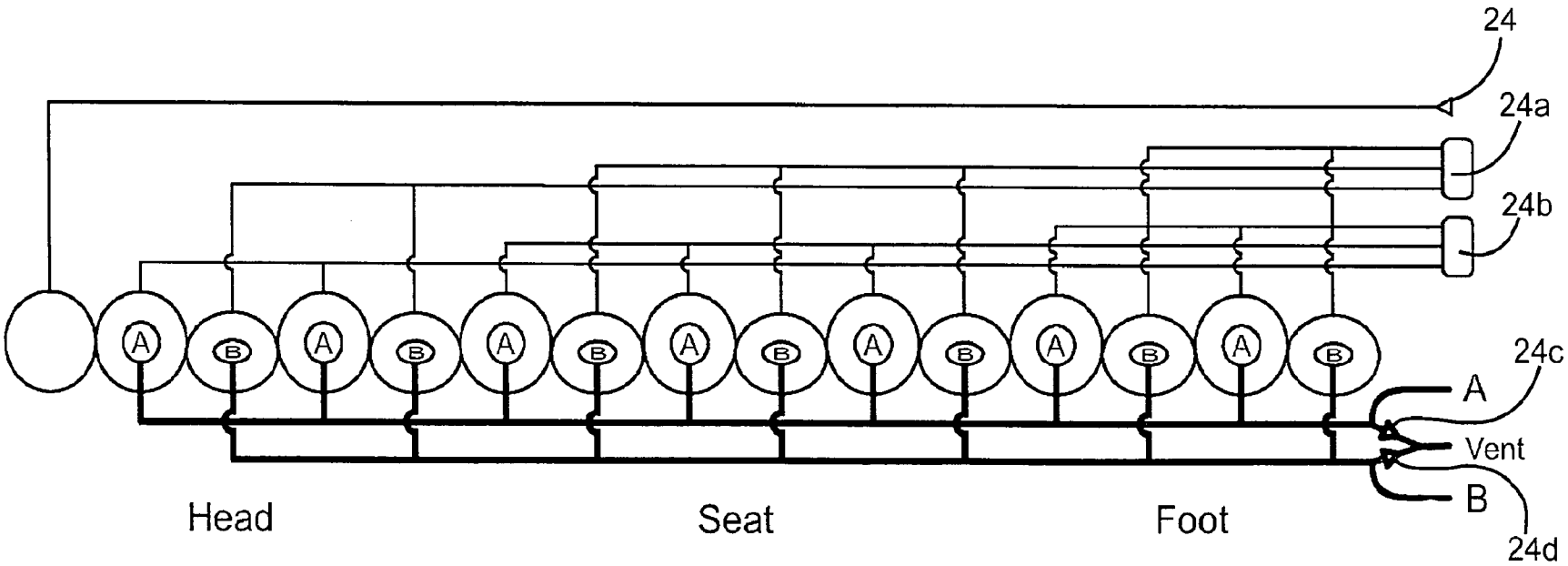
Figure 9C:
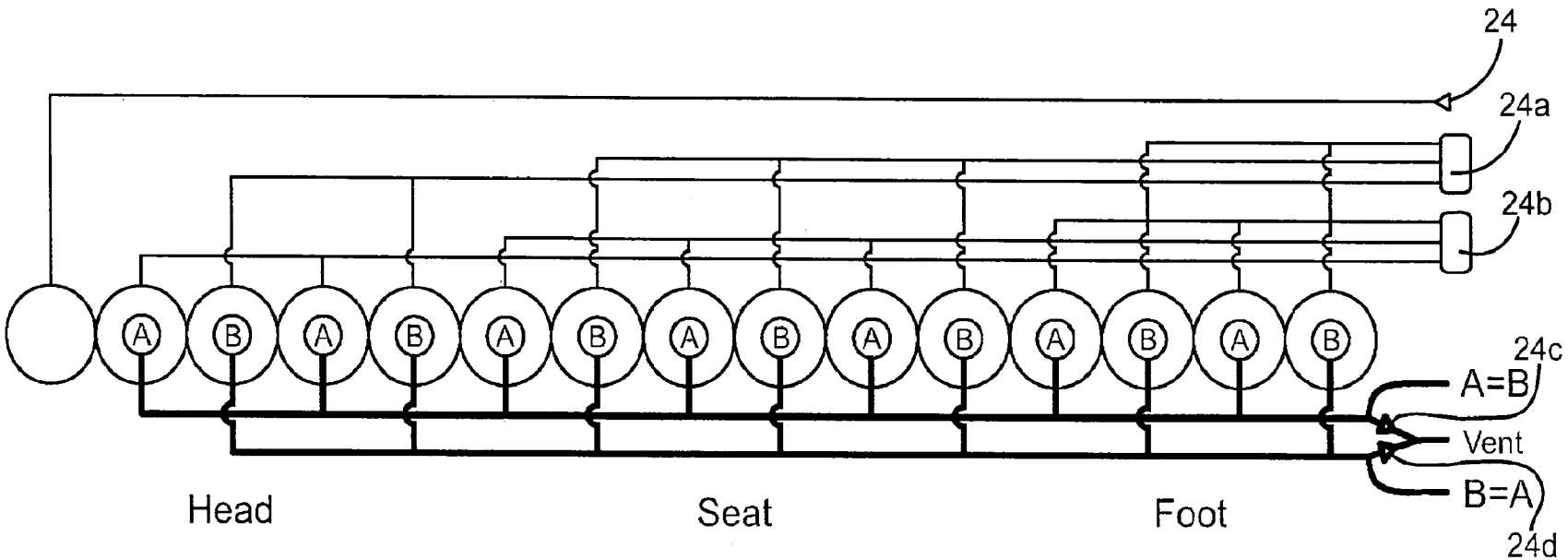

As shown in FIGS. 7 and 8, exemplary cells 48, 50, 52 of the optionally powered mattress 46 have foam inserts 54, 56, 58, like the above-described inserts 34, 36, 38. Within the foam inserts 54, 56, 58 are inner walls 59, 60, 61. These inner walls 59, 60, 61 function like low air permeability envelopes that permit the mattress 46 to be inflated and deflated just like a conventional alternating pressure mattress. The inner walls 59, 60, 61 may be connected together in an alternating fashion along the longitudinal axis of the mattress 46, and may terminate in fittings that can be attached to an alternating pressure mattress pump controller, as shown in FIGS. 9A-9C. This may allow the mattress 46 to be used for application of alternating pressure therapy, if prescribed by a caregiver, without the need to exchange the mattress 46.

In FIG. 7, there is clearly illustrated a perspective view of an exemplary construction of representative cells 48, 50, 52 of the optionally powered mattress 46, wherein the cells 48, 50, 52 have different hollow foam inserts 54, 56, 58 formed from different amounts of foam fill, each with an inner wall 59, 60, 61 for the alternating pressure functionality. The inner wall 59, 60, 61 and the outer wall 69, 70, 71 may be formed from any suitable material that is capable of functioning like a low air permeability envelope, like the outer walls 40, 42, 44 described above.

In FIG. 8, there is illustrated a perspective view of an exemplary construction for representative cells of the optionally powered mattress 46, wherein one of the inner walls 60' is inflated and another inner wall 60" is deflated. As shown in the drawing, the inner walls 60', 60" are inside the foam inserts 56, which in turn are inside the outer walls 70. It should be appreciated that the inner walls 59, 60, 61 and outer walls 70 respectively function as primary and secondary bladders.

The inner walls 59, 60, 61 of alternating cells 48, 50, 52 in each zone 64, 66, 68 are subject to alternating pressure inflation phases. As shown in FIGS. 9A-9C, the alternating cells 48, 50, 52 for each zone 64, 66, 68 may be provided with separate check valves. In this case, multiple filtered check valves are provided in a single molded housing 24*a*, 24*b*. The check valves let air enter the cells 48, 50, 52, but not exit the cells 48, 50, 52. At least one of the end-most cells 62 at the head end of the mattress 46 is preferably not subject to an alternating pressure inflation phase and thus is provided with its own check valve 24. Consequently, the exemplary mattress 46 has seven check valves in all, two for the alternating pressure inflation phases for each of the three zones 64, 66, 68 and one for the end cell 62. In accordance with this construction, when the mattress 46 is not used in powered alternating pressure mode and the inner cells 59,60,61 are deflated, as shown in FIG. 9A, the mattress has substantially the same construction and patient pressure profile as the non-powered mattress 10.

In FIGS. 9A-9C, there are shown three mode of operation of the mattress 46. In FIG. 9A, the mattress 46 is not powered, and thus functions like a low air loss mattress, like the mattress 10 described above. In FIG. 9B, the mattress 46 is connected to controller pump, which produces alternating pressure inflation phases for each of the three zones 64, 66, 68. In this configuration, the mattress 46 is an alternating pressure mattress. In FIG. 9C, the mattress 46 is connected to controller pump, which produces equal pressure in the cell 48, 50, 52 in each of the three zones 64, 66, 68. This configuration may be desirable for a user who does not desire the softer feel of a low air loss mattress or the alternating pressure of an alternating pressure mattress. It should be appreciated that when the controller pump is not connected to the mattress 46, the A-B ports are closed so that air is not permitted to enter the inner walls 59, 60, 61 through the ports. Air within the inner walls 59, 60, 61 can be evacuated from the inner walls 59, 60, 61 through check valves 24*c*, 24*d*, as will become apparent in the description that follows.

Figure 10:
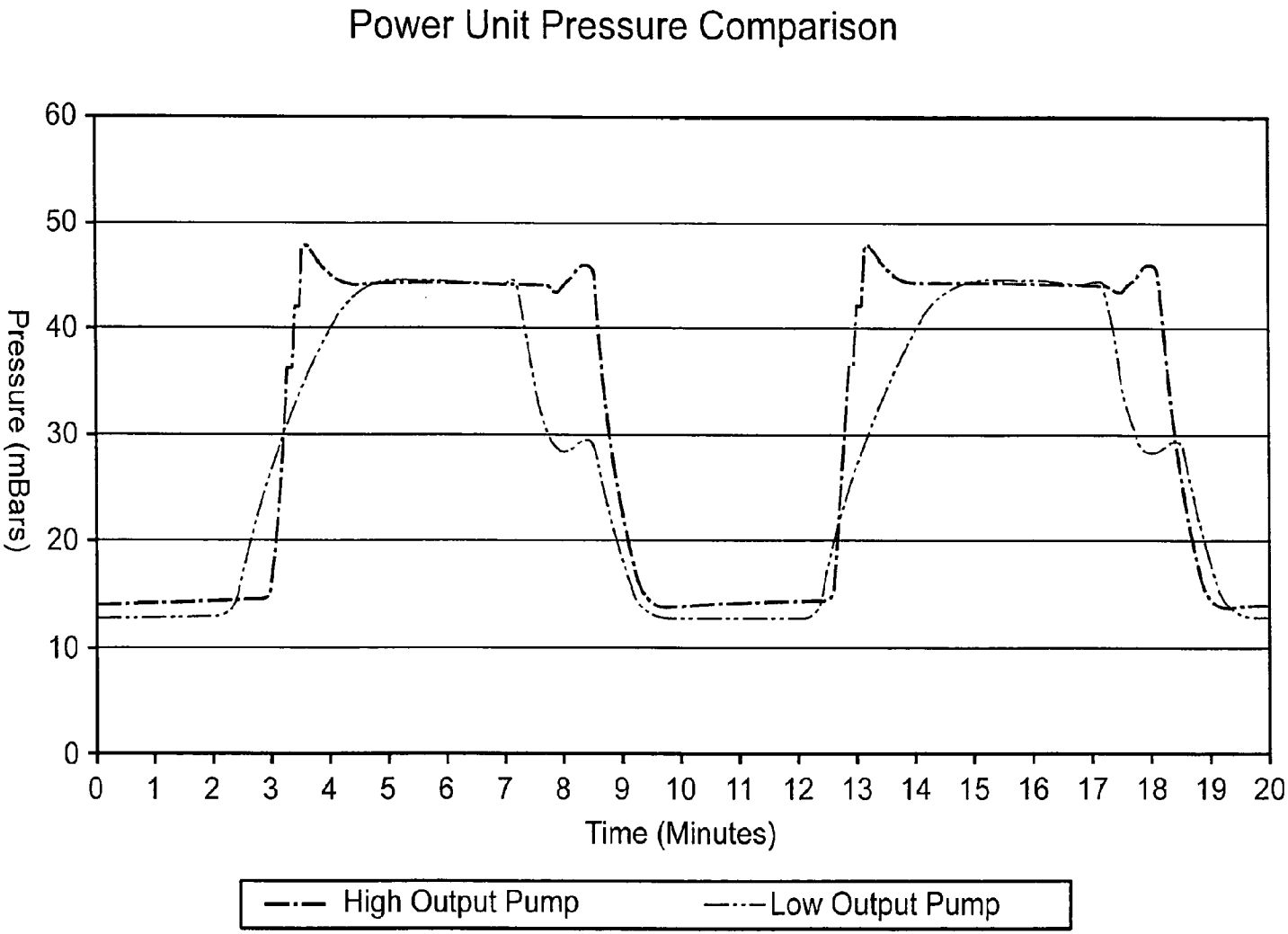
FIG. 10 is a graph of exemplary alternating cell pressures in head, seat, and foot zones of the optionally powered mattresses.

In FIG. 10, there is illustrated a graph of exemplary cell pressures over time for the optionally powered mattress 46. The graph shows two curves, one curve representing a high cost, high output alternating pressure controller pump (i.e., 40 liters per minute) and another curve representing a low cost, low output alternating pressure controller pump (i.e., 10 liters per minute) connected to the mattress 46. The general pressures reached and maintained are similar with both pumps, demonstrating that the mattress 46 can be effectively used with a wide range of controller pumps.

Figure 11:
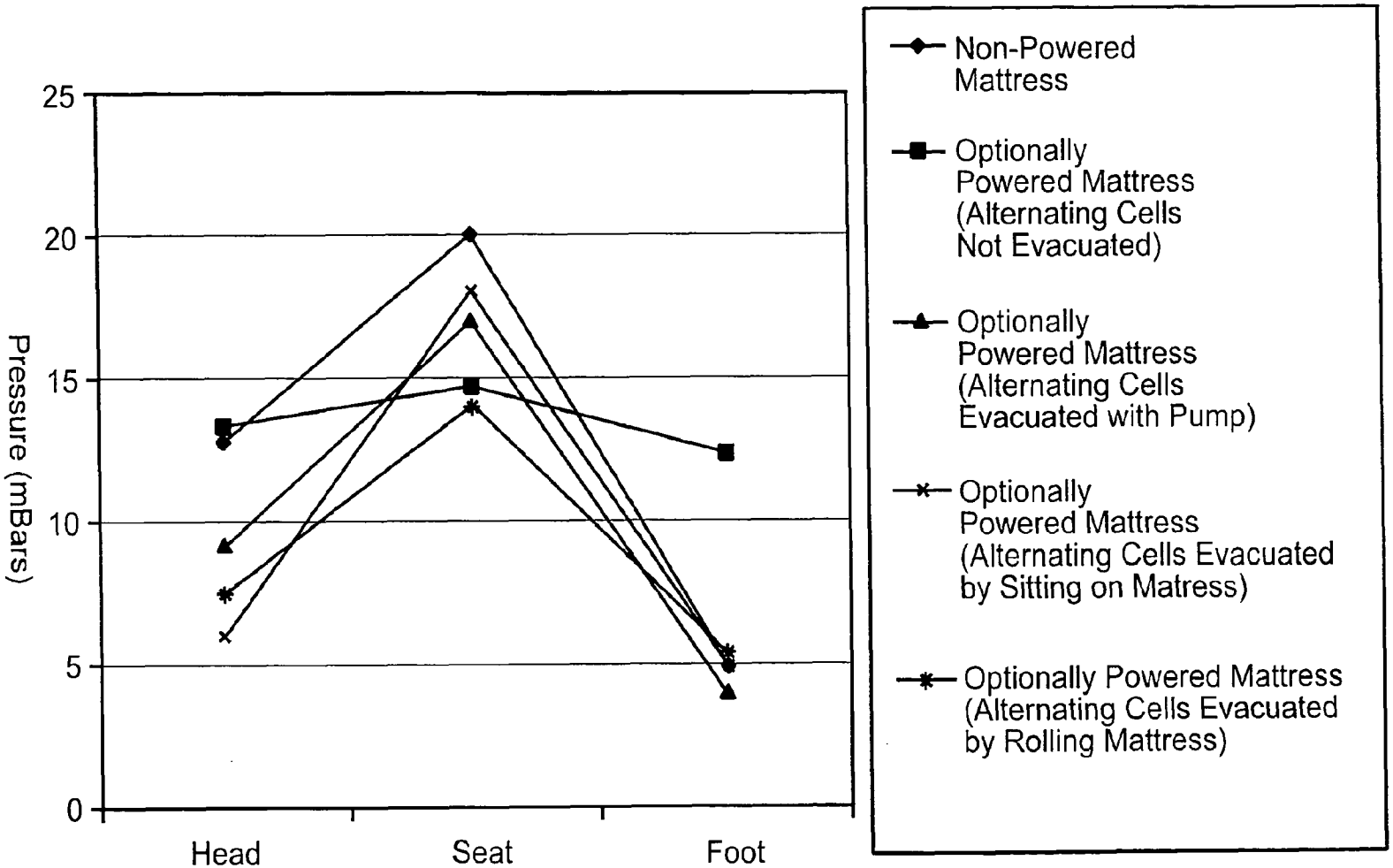
FIG. 11 is a graph of exemplary cell pressures over time of the non-powered and optionally powered mattresses.

In FIG. 11, there is illustrated a graph of exemplary cell pressures for the non-powered mattress 10 and the optionally powered mattress 46 under various conditions. One curve represents pressure characteristics of the non-powered mattress 10 in each of its zones, wherein the cells in the zones are sealed apart from one another. In the powered mattress 46, alternating cells are in fluid communication with one another. The curve represents pressure characteristics of the optionally powered mattress 46 in each of its zones, wherein the inner walls 59, 60, 61 in the alternating cells are not evacuated. Consequently, the air in the inner walls 59, 60, 61 is distributed substantially equally throughout the alternating cells in the three zones 64, 66, 68, so a differential pressure in each of the zones 64, 66, 68 is not readily achieved. For the optionally powered mattress 46 to function like the non-powered mattress 10, the inner walls 59, 60, 61 should be evacuated. It should be appreciated that there is a trend that the air in the inner walls 59, 60, 61 will passively diffuse into the region of the cells 48, 50, 52 outside the inner walls 59, 60, 61 so that a differential pressure in each of the zones 64, 66, 68 will eventually be achieved. Achievement of this pressure differential can be accelerated by actively evacuating the air from the inner walls 59, 60, 61. This active evacuation can be done in various ways. For example, the air in the inner walls 59, 60, 61 can be evacuated through the check valves 24*c*, 24*d* with a pump, by sitting on or other applying a load to the inner walls 59, 60, 61 to compress the inner walls 59, 60, 61, or by rolling the mattress 46 up to compress the inner walls 59, 60, 61 and thus force air in the inner walls 59, 60, 61 out through check valves 24*c*, 24*d*. These checks valves 24*c*, 24*d* allow air to flow out of the inner walls 59, 60, 61 but not into the inner walls 59, 60, 61. Such check valves 24*c*, 24*d* are shown for illustrative purposes in FIGS. 9A-9C. Through active evacuation, differential pressures in the three zones 64, 66, 68 can be achieved, as is characteristic of the three curves, which are similar in characteristic to the curve for the zones 12, 14, 16 in the non-powered mattress 10. This graph illustrates that the optionally powered mattress 46 has a performance characteristic similar to the non-powered mattress 10.

Figure 12:
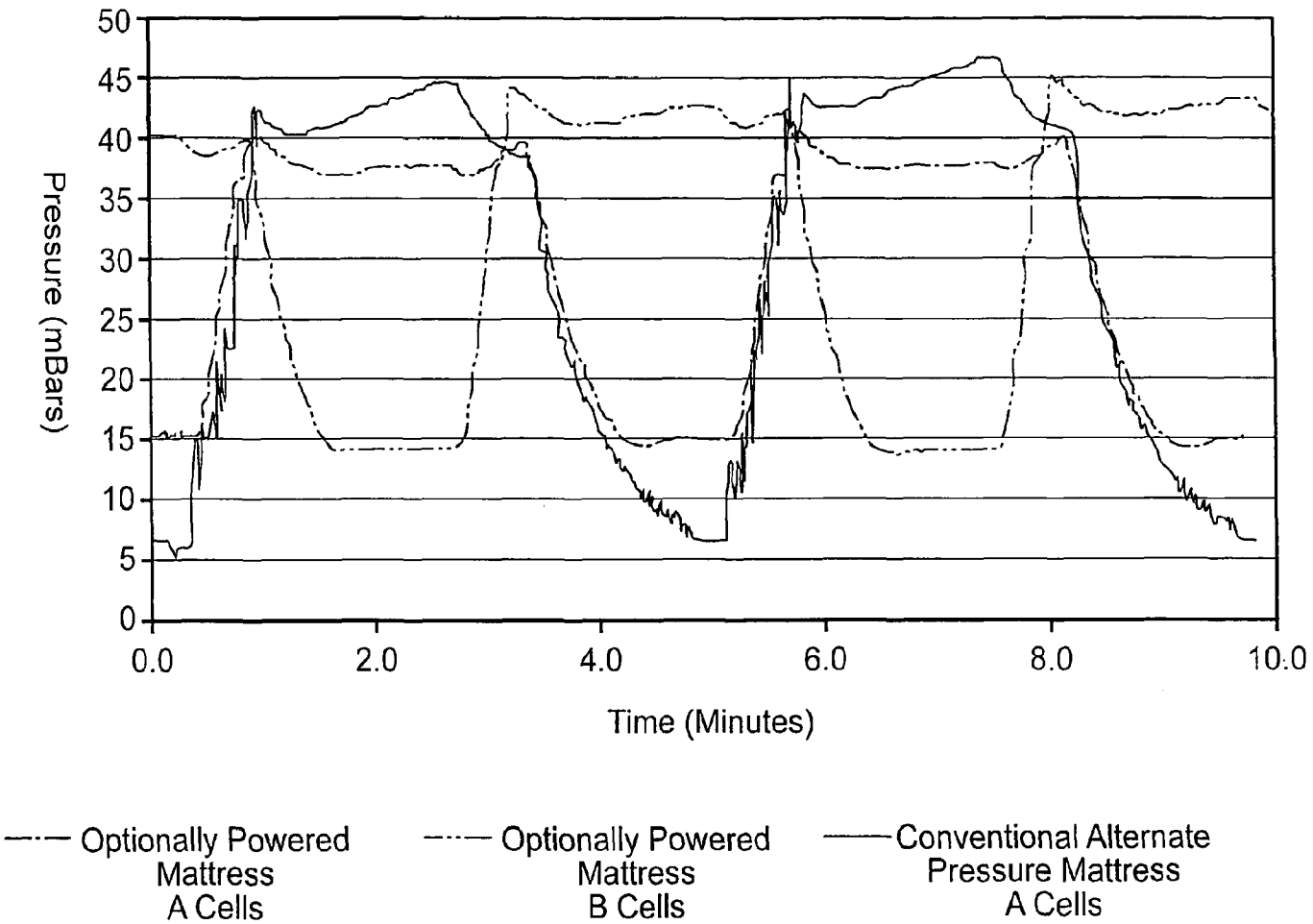
FIG. 12 is a graph of exemplary cell pressures during various modes of operation of the optionally powered mattress and a conventional alternating pressure mattress.

In FIG. 12, there is illustrated a graph of exemplary cell pressures comparisons. The graph shows the alternating pressure cells (labeled "A Cells" and "B Cells" in the graph) of the optionally powered mattress 46 reaching substantially that same pressure over time. The cells are connected together alternately along the longitudinal axis of the optionally powered mattress 46 and are connected to a controller pump that inflates the A cells while deflating the B cells and then deflates the A cells while inflating the B cells. This may continue over a cycles of about 5, 10 or 15 minutes. This is exhibited by the relationship of curves 90, 92. The graph also shows the performance of similar cells of the optionally powered mattress 46 and a conventional alternating pressure mattress, as exhibited by the relation of curves 90, 94. These curves illustrate that the optionally powered mattress 46 has performance characteristics similar to a more conventional powered alternating pressure mattress.

In use, the inner walls 59, 60, 61 within the foam inserts 54, 56, 58 of each cell 48, 50, 52 may provide an alternating pressure surface. The inner walls 59, 60, 61 may be actively controlled, for example, to provide a cyclic inflation and deflation. The optionally powered mattress 46 shown has two sets of inner walls 59, 60, 61 that alternately inflate and deflate, sequenced such that cells 48, 50, 52 are inflated before the adjacent cells are deflated, to insure that the user remains actively supported. This, in turn, may alter a pressure distribution on the user over time, and therefore may improve circulation and reduce the incidence of decubitis ulcers and or promote healing of such ulcers. The inner walls 59, 60, 61 are within the outer walls 69, 70, 71, and may be of much smaller volume. The pressure may be controlled by a standard alternating pressure controller pump as alternative therapy, as and when needed, without replacing the optionally powered mattress 46, which is otherwise passive, with another different active mattress/pump combination.

Like the non-powered mattress 10 described above, the mattress 46 may have a perimeter surround 76 and a topper 78 and be covered with a cover 79, which may function as an environmental barrier. Each air cell 48, 50, 52 may be connected via a hose 80 to form plural zones, such as the head, seat, foot zones 64, 66, 68. The cells in each zone 64, 66, 68 may have a different volume of foam that translates into a different captured air volume upon inflation. That results in a different firmness for each zone 64, 66, 68 and is similar in feel to more costly therapy mattress that incorporate active control over zone pressure.

The inner wall 59, 60, 61 may be formed integrally with the outer walls 69, 70, 71 of each cell 48, 50, 52. In this case, during manufacture, a polyurethane sheet may be radio frequency welded into two concentric spaces, with a respective port formed to communicate with each space. The foam inserts 54, 56, 58 may be inserted within an inner space in a hollow region between the inner wall 59, 60, 61 and the outer wall 69, 70, 71.

The present invention is also applicable to non-medical mattresses and other ergonomic support surfaces, such as beds, couches, chairs, lounges, and the like.

Although the invention is illustrated and described herein as embodied in a foam-filled air cell mattress, it is nevertheless not intended to be limited to the details shown, since various modifications and structural changes may be made therein without departing from the spirit of the invention and within the scope and range of equivalents of the claims.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A mattress comprising:

a plurality of air cells, each having a low air permeability envelope and a foam inflation structure that defines one or more voids inside the low air permeability envelope and that expands when unloaded to cause inflation of the one or more voids;

wherein, when unloaded, the ratio of the volume of the foam inflation structure to the volume of the one or more voids within the low air permeability envelope is not the same in all the cells.

2. The mattress of claim 1, further comprising a plurality of zones, each zone including at least one air cell, wherein the air cells in a zone are connected to each other to allow air to move from inside the low air permeability envelope of one air cell to inside the low air permeability envelope of another air cell in the same zone.

3. The mattress of claim 2, wherein each of the zones includes a check valve that permits air flow into the air cells in that zone and prevents air flow from the air cells in that zone.

4. The mattress of claim 1, further comprising a plurality of zones, each zone including at least one air cell, wherein the air cells in a zone have the same ratio of the volume of the foam inflation structure to the volume of the one or more voids.

5. The mattress of claim 4, wherein the low air permeability envelope of each of the air cells has a similar size.

6. The mattress of claim 4, wherein each of the zones includes a check valve that permits air flow into the air cells in that zone and prevents air flow from the air cells in that zone.

7. The mattress of claim 6, wherein the air cells in a zone are connected to each other to allow air to move from inside the low air permeability envelope of one air cell to inside the low air permeability envelope of another air cell in the same zone.

8. The mattress of claim 7, wherein the low air permeability envelope of each of the air cells has a similar size.

9. The mattress of claim 4, further comprising a plurality of groups of air cells, wherein the air cells in a group are connected to each other to allow air to move from inside the low air permeability envelope of one air cell to inside the low air permeability envelope of another air cell in the same group.

10. The mattress of claim 9, wherein each of the groups of air cells includes a check valve that permits air flow into the air cells in that group of air cells and prevents air flow from the air cells in that group of air cells.

11. The mattress of claim 10, wherein alternating air cells in a zone are in the same group of air cells, and the zone includes air cells in two different groups of air cells.

12. The mattress of claim 1, further comprising:

a plurality of zones, each zone including at least one air cell, a group of air cells, comprising alternating air cells in a select zone, wherein the air cells in the group of air cells are connected to each other to allow air to move from inside the low air permeability envelope of one air cell to inside the low air permeability envelope of another air cell in the group of air cells; and a check valve that permits air flow into the air cells in the group of air cells and prevents air flow from the air cells in the group of air cells;

wherein the select zone includes air cells in two different groups of air cells.

13. The mattress of claim 1, further comprising:

a plurality of zones, each zone including at least one air cell, a plurality of groups of air cells, each of the groups of air cells comprising alternating air cells in one zone, wherein the air cells in each group of air cells are connected to each other to allow air to move from inside the low air permeability envelope of one air cell to inside the low air permeability envelope of another air cell in the same group of air cells; and a plurality of check valves, each of the check valves permitting air flow into the air cells in one of the group of air cells and preventing air flow from the air cells in the same group of air cells;

wherein each zone includes air cells in two different groups of air cells.

14. A mattress comprising:

a plurality of air cells, each having a low air permeability envelope and a foam inflation structure that defines one or more voids inside the low air permeability envelope and that expands when unloaded to cause inflation of the one or more voids, wherein, when unloaded, the ratio of the volume of the foam inflation structure to the volume of the one or more voids within the low air permeability envelope is not the same in all the cells;

a plurality of zones, each zone including at least one air cell; and a plurality of check valves, each zone including a check valve that permits air flow into the air cells in the zone and prevents air flow from the air cells in the zone.

15. The mattress of claim 14, wherein all the air cells in a zone have the same ratio of the volume of the foam inflation structure to the volume of the one or more voids.

16. The mattress of claim 15, wherein the air cells in a zone are connected to each other to allow air to move from inside the low air permeability envelope of one air cell to inside the low air permeability envelope of another air cell in the same zone.

17. The mattress of claim 14, wherein the air cells in a zone are connected to each other to allow air to move from inside the low air permeability envelope of one air cell to inside the low air permeability envelope of another air cell in the same zone.

18. The mattress of claim 17, wherein the low air permeability envelope of each of the air cells has a similar size.

19. A mattress comprising:

a plurality of air cells, each having a low air permeability envelope and a foam inflation structure that defines one or more voids inside the low air permeability envelope and that expands when unloaded to cause inflation of the one or more voids, wherein, when unloaded, the ratio of the volume of the foam inflation structure to the volume of the one or more voids within the low air permeability envelope is not the same in all the cells;

a plurality of zones, each zone including at least one air cell; and a plurality of groups of air cells, each of the groups of air cells comprising alternating air cells in one zone, wherein each zone includes air cells in two different groups of air cells; and a plurality of check valves, each of the check valves permitting air flow into the air cells in one of the group of air cells and preventing air flow from the air cells in the same group of air cells.

20. The mattress of claim 19, wherein the air cells in each group of air cells are connected to each other to allow air to move from inside the low air permeability envelope of one air cell to inside the low air permeability envelope of another air cell in the same group of air cells.

* * * * *